US006073700A

United States Patent [19]

Tsuji et al.

[11] Patent Number: 6,073,700

[45] **Date of Patent: *Jun. 13, 2000**

[54] SPRINKLER HEAD

[75] Inventors: Toshihide Tsuji, Sagamihara; Katsuaki Tonomura, Yokohama; Suguru Shimokawa, Hachiouji, all of Japan

[73] Assignee: Hochiki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/115,723

[22] Filed: Jul. 15, 1998

[30] Foreign Application Priority Data

Jul. 25, 1997 [JP] Japan ..... 9-199687

[51] Int. Cl.[7] ..... A62C 39/00

[52] U.S. Cl. ..... 169/90; 251/11

[58] Field of Search ..... 169/37, 90, 19; 239/512; 251/11

[56] References Cited

U.S. PATENT DOCUMENTS

| | | | |
|---|---|---|---|
| 3,924,687 | 12/1975 | Groos | 169/37 |
| 4,553,602 | 11/1985 | Pieczykolan | 169/19 |
| 4,699,217 | 10/1987 | McLennan et al. | 169/37 |
| 5,494,113 | 2/1996 | Polan | 169/37 |
| 5,533,576 | 7/1996 | Mears | 169/90 |

FOREIGN PATENT DOCUMENTS

| | | | |
|---|---|---|---|
| 310439 | 4/1989 | European Pat. Off. | 169/37 |
| 111300 | 10/1978 | Japan | 169/37 |
| 1488653 | 6/1989 | Russian Federation | 251/11 |

OTHER PUBLICATIONS

On/off sprinklers, Research Disclosure, pp. 194–195, May 1981.

*Primary Examiner*—Andres Kashnikow
*Assistant Examiner*—Dinh Q. Nguyen
*Attorney, Agent, or Firm*—Lackenbach Siegel

[57] ABSTRACT

The present invention is to discharge the fire extinguishing water by accurately opening the valve, using a shape-memory alloy at a predetermined temperature in a fire. When a shape-memory alloy in a first heat sensitive operation part is heated to a predetermined memory restoring temperature, a pilot valve is operated by the restoring force thereof so that a spool valve can be in a state capable of being opened by an actuator. When a second heat sensitive operation part reaches a predetermined water discharge starting temperature higher than the memory restoring temperature, a fusible alloy provided inside is thermally decomposed so that the first heat sensitive operation part maintained in the closed state is released so as to discharge the fire extinguishing water. When the temperature becomes lower than the memory restoring temperature by the fire extinguishment by the water discharge, a restoring spring deforms the shape-memory alloy into the initial shape so as to drive the valve mechanism into the closed state for stopping the water discharge. Accordingly, since the start of the water discharge can be controlled by the water discharge starting temperature having less fluctuation with respect to the memory restoring temperature, the water can be discharged further accurately. Moreover, since the memory restoring temperature needs not be set accurately, the production efficiency of the sprinkler head can be improved to facilitate the mass productivity.

11 Claims, 10 Drawing Sheets

PRIOR ART

PRIOR ART

SPRINKLER HEAD

BACKGROUND OF THE INVENTION

1. Field of the Invention

The present invention relates to an automatically switchable sprinkler head for automatically discharging fire extinguishing water by opening a valve against the surrounding temperature rise by a fire and automatically ceasing the water discharge by closing the valve against the surrounding temperature drop by the extinguishment of the fire.

2. Description of the Related Art

In conventional sprinkler heads, the channel connecting the water supply opening of the head connecting part for the fire extinguishing pipe and the water discharge opening at the tip of the head is sealed by a heat sensitive material, which is melted by the heat of the fire, such as a fusible alloy. When the temperature is raised over a predetermined temperature by a fire, the heat sensitive material is melted so that the channel is opened for discharging water.

Therefore, once the channel is opened by the drive of the sprinkler head by the hot air in the fire, the water discharge continues even after the extinguishment of the fire until the water supply from the water source is finished, or the valve is closed manually by a clerk, who confirms the site so that the damage by the water discharge has been considerable.

Accordingly, a sprinkler head, which opens the valve by the temperature rise by a fire so as to automatically discharges water and closes the valve by the temperature drop by the extinguishment of the fire so as to automatically ceases the water discharge, using a bimetal or a shape-memory alloy has been proposed.

Specifically, U.S. Pat. No. 4,553,602, Japanese Unexamined Patent Publication No. 53-48397, and Japanese Unexamined Utility Model Publication No. 54-131800 (based on the priority claim: U.S. Application No. 196641 filed on Nov. 8, 1971) disclose a sprinkler head utilizing a bimetal.

Further, Japanese Unexamined patent Publication No. 60-249978 (based on the priority claim: U.S. application No. 605201 filed on Apr. 30, 1984) and Japanese Unexamined Patent Publication No. 5-123419 disclose a sprinkler head utilizing a shape-memory alloy.

In such a conventional sprinkler head, when the surrounding of the sprinkler head has an ordinary temperature, the bimetal or the shape-memory alloy is maintained in the ordinary temperature shape. In this state, the water discharging path inside the sprinkler head is kept in the closed state directly by the bimetal or the shape-memory alloy in the ordinary temperature state or indirectly via an optional element. When the temperature surrounding the sprinkler head is higher than a predetermined operating temperature, the bimetal deforms into a high temperature shape, or the shape-memory alloy restores the memorized shape. At the time, the water discharging path is opened by the deformed bimetal or restored shape-memory alloy so that the water discharging operation is initiated. Further, when the surrounding of the sprinkler head regains an ordinary temperature after the extinguishment of the fire by the water discharge, the bimetal or the shape-memory alloy deforms to the ordinary temperature shape so as to close the water discharging path.

In summary, in the conventional sprinkler heads, the water discharging path is opened by the bimetal deformation or the restoration of the shape-memory alloy caused by a temperature higher than a predetermined operating temperature.

However, a problem is involved in the bimetal corrosion. That is, the expected deformation cannot be achieved even at the predetermined operating temperature due to the bimetal corrosion so that the sprinkler head cannot be operated.

Further, since the temperature at which a bimetal deforms or a shape-memory alloy restores can be defined only in a range within several ten degrees so that the temperature at which the deformation or the restoration takes place cannot be pinpointed in the range. Therefore, the temperature at which the water discharging path is opened, that is, the sprinkler head starts the operation cannot be determined accurately. For the same reason, when the water discharging path is closed after the water discharge, the temperature at which the water discharging path is closed, that is, the operation of the sprinkler head is ceased cannot be determined accurately. Hence it has been difficult to accurately operate a conventional sprinkler head.

Moreover, in the conventional sprinkler heads, the water discharge is controlled only by the bimetal or the shape-memory alloy as mentioned above. Therefore, in order to discharge water at a predetermined water discharging temperature, a shape-memory alloy needs to be produced and assembled such that it can be immediately restored when the surrounding temperature reaches the water discharging temperature. However, as mentioned above, since the temperature at which a shape-memory alloy restores can be defined only in a range within several ten degrees, and due to the production difficulty of a shape-memory alloy, which can immediately restore at a predetermined temperature and generation of a production error, adjustment of each sprinkler head in assembly has been required. This makes the sprinkler head inefficient, and deteriorates the mass-productivity.

The above-mentioned problems will be explained more specifically with reference to an automatically switchable sprinkler head using a shape-memory alloy disclosed in Japanese Unexamined Patent Publication No. 5-123419.

A sprinkler head of FIG. 9 has a coil spring-like shape-memory alloy 120 at a lower part of a main body 101. When the shape-memory alloy 120 exceeds a predetermined temperature by a fire, the shape-memory alloy 120 restores a preliminarily memorized stretched shape from the coil-spring shape. The restored shape-memory alloy 120 opens a pilot valve hole 110 by pushing up a pilot valve body 112 provided on a valve shaft 111, resisting to a spring 113. Accordingly, the pressure in a room above a piston 108 is lowered to raise the piston 108 so that a rubber packing 114 leaves a valve seat and fire extinguishing water is discharged from a water discharging opening 116.

When the temperature is lowered by the extinguishment of fire by the water discharge, the restoring force to the memorized shape of the shape-memory alloy 120 is lowered so that the pilot valve body 112 is pushed down by the spring 113 to close the pilot valve hole 110. Accordingly, the piston is pushed down by the pressure introduction of the fire extinguishing water from a pilot introduction hole 104 so that the valve seat is closed with the rubber packing 114 to automatically cease the water discharge.

However, in the automatically switchable sprinkler head using a shape-memory alloy as mentioned above, the operation cannot be conducted securely by opening the valve at a predetermined temperature in a fire.

FIG. 10 shows an elastic modulus of a shape-memory alloy with respect to the temperature. The restoring force is proportional to the elastic modulus. The shape-memory alloy is in the crystalline state of a martensite phase. With the temperature rise, it transfers to the crystalline state of an austenite phase. A shape-memory region, which is known as a two phase region, exists therebetween. The shape-memory region has a range in the temperature, for example, of more than several ten degrees.

In order to open a valve in a fire, using the shape-memory alloy 120 having such a characteristic, an operating temperature T1 is determined for starting the water discharge subject to hot air in the fire, and an elastic coefficient G1 corresponding to the operating temperature T1 at the point P is sought. Once the elastic coefficient G1 is sought, the restoring force of the shape-memory alloy 120 having a coil spring-like shape at the operating temperature T1 can be determined so that the force of the spring 113 is set such that the pilot valve body 112 is opened by the restoring force.

Then, the shape-memory alloy 120 is deformed to a stretched memorized shape while being heated at a predetermined operating temperature T1, and contracted to the initial shape before the memorizing operation in an ordinary temperature so as to be assembled as shown in FIG. 9.

However, since the elastic coefficient of the shape-memory alloy increases in the shape-memory region according to the temperature rise as shown in FIG. 10, the restoring force to the memorized shape gradually increases accordingly. On the other hand, the force for opening the pilot valve body 112 fluctuates by the fire extinguishing water pressure introduced into the piston room 109 and the sliding resistance of the valve shaft 111 in addition to the spring 113 force, and thus it has an irregularity to some extent.

Therefore, even if a predetermined restoring force is set by memorizing a stretched shape in the shape-memory alloy 120 at the predetermined operating temperature T1, the restoring force gradually increases according to the temperature rise. With a lowered force for opening the pilot valve 112, the water discharge can be started at a temperature lower than the predetermined operating temperature T1. Or with an increased force for opening the pilot valve 112, the water discharge can be started at a temperature higher than the predetermined operating temperature T1.

As a result, start of the water discharge when it reaches a predetermined operating temperature T1 by hot air in a fire cannot be ensured so that the operating temperature for starting the water discharge cannot be stable, and thus a problem is involved in the lack of reliability. Further, mass production is extremely difficult due to the need of labor in adjusting the shape-memory alloy.

Besides, if the fire extinguishing water is discharged from the water discharging opening 116 with the piston 108 raised in a fire, the water is scattered below the sprinkler head. Therefore, the fire extinguishing water is poured onto a lid 115 so as to cool down the shape-memory alloy 120 by the fire extinguishing water itself, resulting in the termination of the water discharge from the sprinkler head without extinguishing the fire.

Furthermore, if the lid 115 is damaged by the clash of the sprinkler head with a substance, the sprinkler head cannot be operated in a fire.

SUMMARY OF THE INVENTION

In order to solve the above-mentioned conventional problems, an object of the present invention is to provide an automatically switchable sprinkler head, capable of accurately opening a valve in a fire at a predetermined temperature using a shape-memory alloy so as to discharge fire extinguishing water with excellent reliability and mass productivity.

In order to achieve the object, the present invention has the following configuration. A subject of the present invention is a closed type sprinkler head for discharging fire extinguishing water in a fire, comprising a valve mechanism for switching the channel of the fire extinguishing water, connected to a fire extinguishing piping filled with the fire extinguishing water supplied with pressure.

A closed type sprinkler head in the present invention comprises a first heat sensitive operation part where a shape-memory alloy and a restoring force member are arranged facing to each other so that the shape-memory alloy is deformed to an initial shape by the restoring force member so as to maintain a valve mechanism at a water discharge stopping position when the temperature of the shape-memory alloy is lower than a predetermined memory restoring temperature, and the valve mechanism can be driven to a water discharging position by the restoring force of the shape-memory alloy to a memorized shape when the temperature of the shape-memory alloy reaches the memory restoring temperature, and a second heat sensitive operation part where a predetermined water discharge starting temperature higher than the memory restoring temperature is set so that the valve mechanism is maintained in a closed state regardless of the operation state of the first heat sensitive operation part when the temperature is lower than the water discharge starting temperature, and the closure of the valve mechanism is released so as to discharge fire extinguishing water by thermally disassembling itself at least partially when the temperature reaches the water discharge starting temperature.

It is more preferable that when the valve mechanism is in a state capable of being driven to the water discharging position, with the shape-memory alloy temperature lower than the memory restoring temperature, the valve mechanism is closed so as to cease the water discharge by the deforming the shape-memory alloy into the initial state by the restoring force member in the first heat sensitive operation part.

In such a sprinkler head according to the present invention, by receiving hot air by a fire, when it reaches the memory restoring temperature of the shape-memory alloy set at a low level, the shape-memory alloy generates the restoring force to deform into the memorized shape so that the first heat sensitive operation part is driven so as to have the valve mechanism in a state capable of discharging water. In this state, when the temperature is further raised by the hot air so that it reaches the predetermined water discharge starting temperature, the fusible alloy or the glass valve of the second heat sensitive operation part is thermally disassembled so that the sustenance of the operation of the first heat sensitive operation part already functioning in the water discharge available state is released so as to start the water discharge.

Therefore, even if the shape-memory alloy has a range in the memory restoring temperature, since the water discharge starting temperature can be ensured by being set at a predetermined temperature by the fusible metal or the glass valve provided in the second heat sensitive operation part as a heat sensitive member, the reliability of the automatically switchable sprinkler head using the shape-memory alloy can be ensured.

The temperature for starting the water discharge can be determined by the fusible alloy or the glass valve of the second heat sensitive operation part where the disassembling temperature can be easily set. On the other hand, the memory restoring temperature needs not be set accurately concerning the shape-memory alloy, having the memory restoring temperature hardly set accurately. Accordingly, since much time is not needed for the production or adjustment of a shape-memory alloy unlike the conventional products, the production efficiency of the sprinkler head can be improved so as to facilitate the mass productivity.

Moreover, since the water discharge is started only when both of the first heat sensitive operation part and the second heat sensitive operation part are driven in this configuration, even if, for example, the device is damaged by the clash with a substance during monitor, it is almost impossible that both of them are driven into the operation state due to the damage so that the inadvertent water discharge caused by the damage can be securely prevented.

With the temperature drop by the extinguishment of the fire by the water discharge, the valve mechanism in the first heat sensitive operation part can be in a closed state to automatically cease the water discharge owing to the shape-memory alloy deformation into the initial shape by the restoring force member, and thus damage by water after extinguishing the fire can be restrained at the minimum level.

Further, the temperature for stopping the water discharge is a shape restoring temperature set at a lower level with respect to the water discharge starting temperature set in the second heat sensitive operation mechanism, and by setting the water discharge stopping temperature at a sufficiently low level, the possibility of recurrence of the fire after the extinguishing operation can be drastically lowered.

It is further preferable that if the shape-memory alloy temperature regains the memory restoring temperature after stopping the water discharge by deforming the shape-memory alloy in the initial shape by the temperature drop by the water discharge in the first heat sensitive operation part, the water is discharged again by driving the valve mechanism to the water discharging position by the restoring force of the shape-memory alloy to the memorized shape. Therefore, if by any chance, the fire gains the momentum again after stopping the water discharge, the water discharge is automatically resumed so that the fire can be extinguished securely.

It is more preferable that the a plurality of shape-memory alloys are provided in the first heat sensitive part, surrounding the second heat sensitive operation part so that the valve mechanism can be driven to the water discharging position when at least one of the plurality of the shape-memory alloys restores the memorized shape. By accordingly providing shape-memory alloys in a plurality, the temperature difference by the direction of the hot air in a fire can be offset, and thus the water discharge operation can be conducted securely.

It is further preferable that the valve mechanism is driven into the closed state so as to stop the water discharge when all of the plurality of the shape-memory alloys restore the initial shape. Therefore, since the water discharge cannot be stopped as long as hot air flows from any direction, the fire can be extinguished securely.

It is more preferable that a water sprinkling part to be exposed below the sprinkler head when the second heat sensitive operation part is driven is provided so that the water discharge stoppage before completing the extinguishment of the fire can be prevented due to the cool-down of the shape-memory alloy by the fire extinguishing water itself by providing the shape-memory alloy above the exposed water sprinkling part, and further, the malfunction caused by the blockage of the hot air toward the shape-memory alloy with the fire extinguishing water can be prevented.

It is further preferable that the shape-memory alloy used in the first heat sensitive operation part has an initial shape of a coil spring contracted in the axial direction and a memorized shape of a coil spring stretched in the axial direction. The shape-memory alloy can have an initial shape of a plate spring shape with the center bent in an arc-like shape, and a memorized shape of a plate spring shape stretched in the axial direction.

It is more preferable that the valve mechanism comprises a main valve provided switchably in the channel from the inflow opening to the water discharging opening, an actuator for driving the main valve into the closed position by the pilot pressure supply and driving the main valve into the opened position by the pilot pressure discharge, and a pilot valve for supplying the pilot pressure to the actuator at the valve position determined by the initial shape of the shape-memory alloy so as to close the main valve and discharging the pilot pressure from the actuator at the valve position determined by the shape-memory alloy deformation to the memorized shape so as to open the main valve for the water discharge.

Herein, the actuator comprises a shaft member having a diaphragm piston or a piston slidably by the introduction or discharge of the pilot pressure integrally, with the diaphragm piston or the piston maintained at the closed state by the second heat sensitive operation part.

Another embodiment of the valve structure comprises a first valve member provided switchably in the channel from the inflow opening to the water discharging opening, maintained at the closed position by the second heat sensitive operation part, to be driven to the opened position by the release at the time of attaining the water discharge starting temperature for the water discharge, a second valve member provided in the secondary channel of the first valve member for switching the channel, an actuator for driving the second valve member to the closed state by the pilot pressure introduction from the inflow opening side and driving the second valve member to the opened state by the pilot pressure discharge, and a pilot valve for introducing the pilot pressure to the actuator at the valve position determined by the initial shape of the shape-memory alloy so as to drive the second valve member in the closed state and discharging the pilot pressure at the valve position determined by the shape-memory alloy deformation into the memorized state for discharging water, and driving the second valve member into the closed state for stopping the water discharge by the re-introduction of the pilot pressure when the shape-memory alloy restores the initial shape after driving the first valve member into the opened position.

It is more preferable that the second heat sensitive operation part comprises a fusible alloy or a glass valve to be disassembled by the heat attaining the water discharge starting temperature so as to be removed from the second heat sensitive operation part so that the water discharge starting temperature can be set accurately.

Moreover, a shape-memory alloy using, for example, an NiTi alloy has a high corrosion resistance as the material characteristic so that a high reliability can be ensured by the secure operation started by the hot air in a fire even after the installation over a long period. Furthermore, since there is no need for depending on the fire detection signal from a fire alarm concerning the stoppage and start of the water discharge, the problem of the water discharge caused by the malfunction of the fire alarm can be avoided so that the reliability can be ensured when it is mounted in fixed fire extinguishing equipment.

DESCRIPTION OF THE PREFERRED EMBODIMENT

Figure 1:
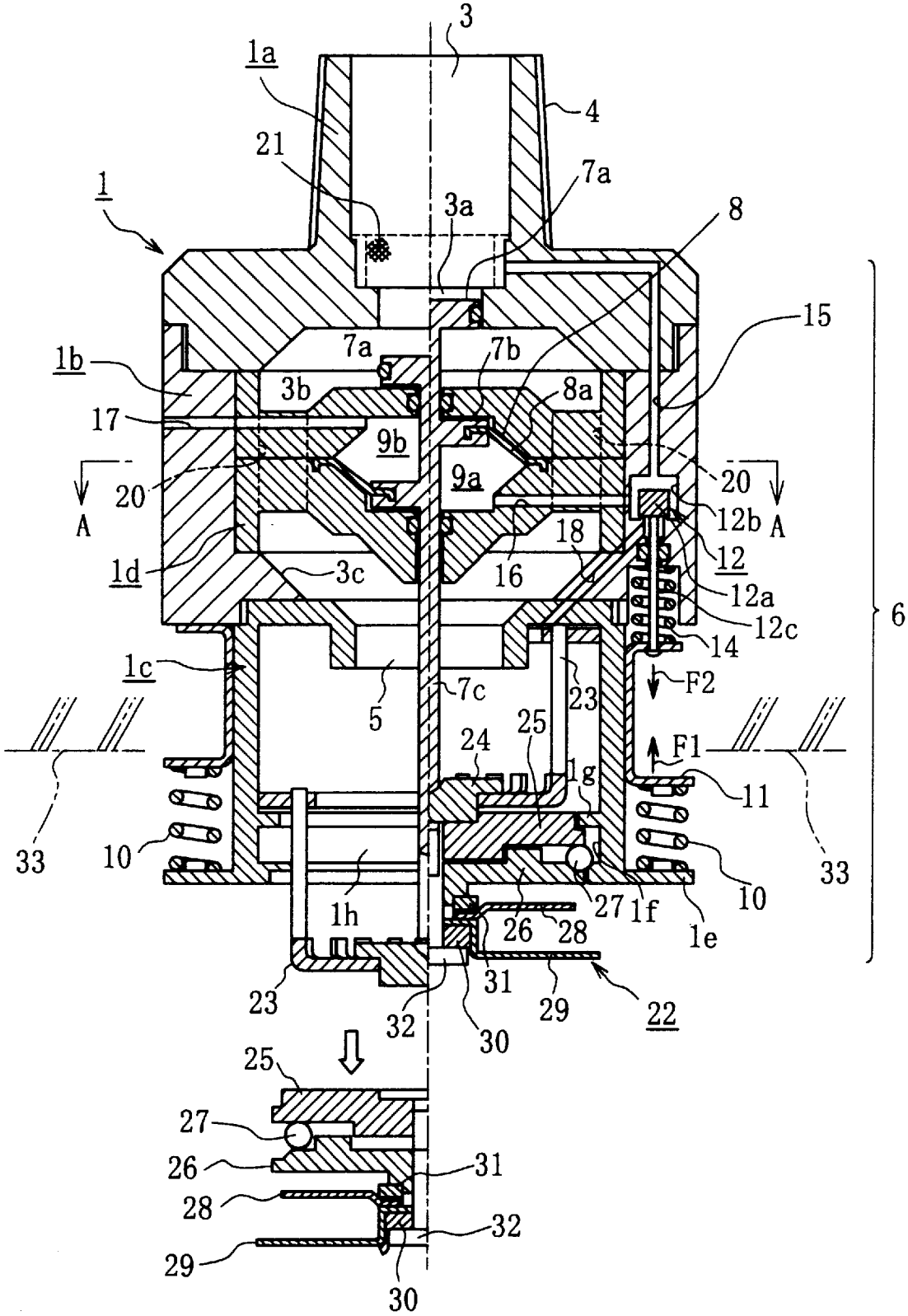
FIG. 1 is a cross-sectional view showing half each of the monitor state and the water discharge state of a first embodiment of the present invention.

FIG. 1 is a vertical cross-sectional view of a first embodiment of an automatically switchable sprinkler head of the present invention. The right side with respect to the center line in the axial direction shows the cross-sectional structure of a constant monitor state where the water discharge is ceased, and the left side shows the cross-sectional structure of a state in the water discharging operation subject to hot air in a fire.

In FIG. 1, a sprinkler head 1 comprises a head connecting part 1*a*, a head main body part 1*b*, and a head water discharging part 1*c* from the above, screwed to each other in the axial direction. An actuator storing part 1*d* is assembled inside the central head main body part 1*b*.

The head connecting part 1*a* has a connecting screw 4 to be connected with a water supply piping for supplying pressed fire extinguishing water so that the pressed fire extinguishing water filled in the water supply piping from an inflow opening 3 can be introduced. A strainer 21 is mounted at the end of the inflow opening 3 for eliminating dusts.

A spool hole 3*a* is provided next to the position where the strainer 21 is assembled. The spool hole 3*a* communicates with an internal channel 3*b*. The spool hole 3*a* further leads to an internal channel 3*c* at the lower part through a communicating hole 20 in the periphery of the actuator storing part 1*d* with respect to the axial direction, and finally communicates with a water discharging opening 5 inside the head water discharging part 1*c*.

A spool valve body 7*a* is disposed in the spool hole 3*a* provided next to the inflow opening 3 in a constant monitor state for closing between the inflow opening 3 and the internal channel 3*b*. The spool valve body 7*a* is formed at one end of a valve shaft 7*c*. Next to the spool valve body 7*a* is a piston part 7*b* integrally formed in the actuator storing part 1*d*. An actuator 8 for switching the spool valve body 7*a* is assembled inside the actuator storing part 1*d*.

The actuator 8 is fixed by mounting the inner periphery part of a diaphragm 8*a* to the piston part 7*b* integrally formed in the valve shaft 7*c*, and sandwiching the outer periphery part of the diaphragm 8*a* with the actuator storing part 1*d* having a vertically-split structure. Accordingly, the storing room of the diaphragm 8*a* is partitioned into a lower side diaphragm room 9*a* and an upper side diaphragm room 9*b*.

As shown in the right side of the head main body part 1*b*, a pilot valve 12 is provided for the actuator 8. In the pilot valve 12, a pilot valve body 12*a* is accommodated in a pilot valve room 12*b*, with a valve shaft 12*c* elongating from the lower part of the pilot valve body 12*a*.

The pilot valve room 12*b* communicates with a pilot inflow channel 15 from the part where the strainer 21 is assembled in the inflow opening 3. The pilot valve room 12*b* further communicate with the diaphragm room 9*a* via a pilot supply path 16. Moreover, the lower part of the pilot valve body 12*a* communicates with a pilot discharge path 18 toward the opened part inside the head water discharging part 1*c*.

The pilot discharge path 18 is connected with the inside of the head water discharging part 1*c* for keeping a shape-memory alloy 10 provided outside the head water discharging part 1*c* away from the fire extinguishing water discharged from the pilot discharge path 18 by the pilot pressure discharge driven by the operation of the pilot valve 12, resulting in lowering the temperature heated by hot air.

A restoring spring (restoring force member) 14 and the shape-memory alloy 10 are provided below the pilot valve 12, forcing with each other via a cylindrical spacer 11 surrounding the outer periphery of the head water discharging part 1*c*. The shape-memory alloy 10 has a shape wound like a coil spring in this embodiment so as to be assembled in plural positions inside a protruding part 1*e* in the lower end outer periphery part of the head water discharging part 1*c*.

The lower end of the valve shaft 12*c* of the pilot valve 12 is fixed to a spacer 11 provided in the outer periphery part of the head water discharging part 1*c* next to the shape-memory alloy 10 slidably in the axial direction, with a restoring spring 14 assembled therebetween.

As the shape-memory alloy 10, for example, one using an NiTi alloy, and the like, having a one-way property with a high corrosion resistance can be used. The one-way property of a shape-memory alloy herein denotes the property where the shape-memory alloy is deformed into the initial shape at a low temperature after memorizing a constant shape at a predetermined memory restoring temperature so that it regains the memorized shape by being heated into a memory restoring temperature higher than the transformation point, but it cannot regain the initial shape deformed at a low temperature by being in the low temperature again thereafter.

The restoring shape with the coil spring stretched in the axial direction is memorized in such a one-way shape memory alloy 10 at a predetermined memory restoring temperature T1. Then the shape-memory alloy is contracted into the initial shape as illustrated in a low temperature so as to be assembled between the protruding part 1*e* and the spacer 11. The restoring force F1 of the shape-memory alloy 10 at the low temperature state in the initial shape is sufficiently lower than the restoring force F2 of the restoring spring 14 assembled in the pilot valve 12 side so that the shape-memory alloy 10 can maintain the initial shape as illustrated by receiving the pressure by the restoring force F2 of the restoring spring 14.

In a low temperature where the shape-memory alloy 10 has the initial shape, the pilot valve body 12*a* is maintained at a position for closing the pilot discharge path 18 as illustrated by the restoring force F2 of the restoring spring 14. Therefore, the pilot pressure from the pilot inflow path 15 stemming from the fire extinguishing water supplied in the inflow opening 3 is supplied to the diaphragm room 9*a* of the actuator 8 through the pilot valve 12 and the pilot supply path 16. The pilot pressure pushes up the piston part 7*b* with the diaphragm 8*a* so that the spool valve body 7*a* is fitted into the spool hole 3*a* for closing the channel from the inflow opening 3 to the internal channel 3*b*.

On the other hand, if the sprinkler head 1 receives hot air by a fire so that the shape-memory alloy 10 assembled in the periphery of the head water discharging part 1*c* is heated, the restoring force F1 is increased by the stretch of the shape-memory alloy 10 into the memorized shape. When the restoring force F1 exceeds the restoring force F2 of the restoring spring 14, the pilot valve body 12*a* is pushed upward by the valve shaft 12*c* via the spacer 11 so that the pilot discharge path 18 is closed with respect to the pilot valve room 12*b* and at the same time the pilot inflow path 15 is closed.

Accordingly, the pilot pressure supplied to the diaphragm room 9*a* of the actuator 8 flows away from the diaphragm room 9*a* through the pilot discharge path 18. Then, the spool valve body 7*a* is pushed downward by the pressure of the fire extinguishing water functioning on the spool valve body 7*a* so that the spool hole 3*a* can be in a state to be opened.

Figure 2:
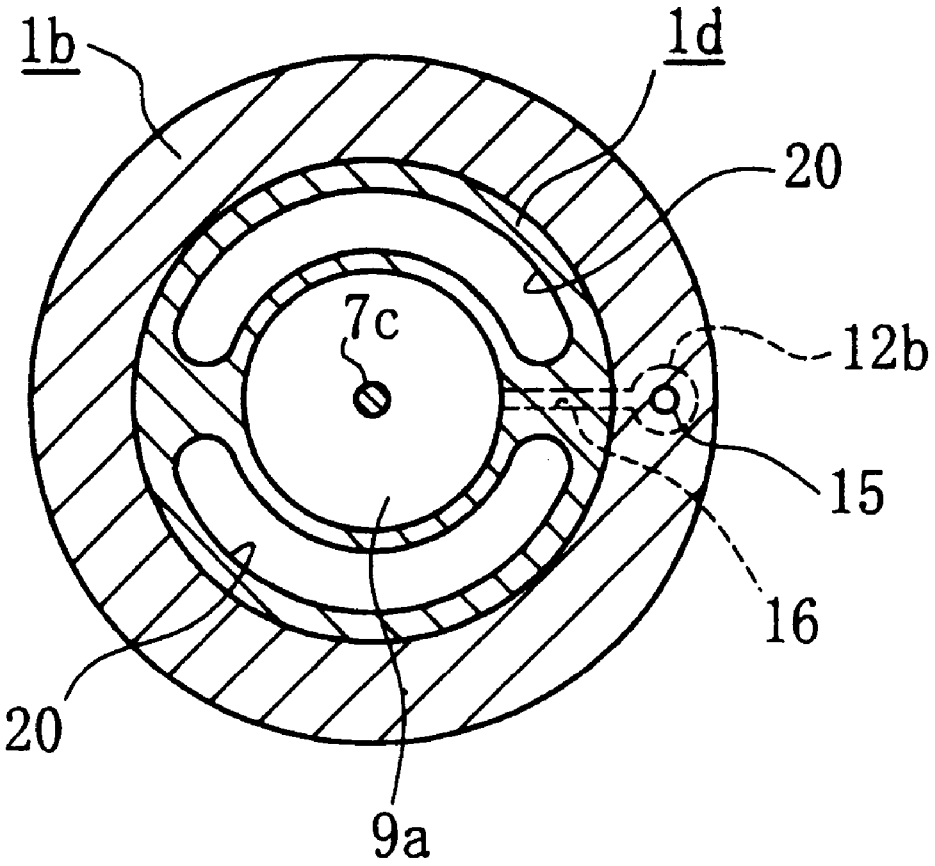
FIG. 2 is a cross-sectional view taken on the line A—A of FIG. 1.

FIG. 2 is a cross-sectional view of the head main body part 1*b* of FIG. 1 taken on the line A—A. Communicating holes 20 separated in two positions are provided in the periphery of the actuator storing part 1*d* assembled inside, with the diaphragm room 9*a* of the actuator formed in the center. The diaphragm room 9*a* is connected with the pilot supply path 16 from the pilot valve room 12*b* of the pilot valve 12 assembled in the head main body part 12*b* side and further, a pilot inflow path 15 is provided upward.

As apparent from the left side cross-section of FIG. 1, the diaphragm room 9*b* above the diaphragm 8*a* is opened to the atmosphere by an atmosphere communication path 17 so that the piston part 7*b* can be moved vertically.

The first heat sensitive operation part 6 of the present invention is provided with a configuration including the spool valve body 7*a*, the actuator 8, the shape-memory alloy 10, the restoring spring 14 and the pilot valve 12 provided in the sprinkler head 1 shown in FIGS. 1 and 2.

A second heat sensitive operation part 22 is provided at the head water discharging part 1*c* side with respect to the first heat sensitive operation part 6. The second heat sensitive operation part 22 accommodates a deflector 23 descendably below the water discharging opening 5, maintained by a heat sensitive operation mechanism using a fusible alloy 30, which is a part of itself. That is, a supporting member 24 is mounted in the center part of the deflector 23, with the center concave part of the supporting member 24 contacting with the tip of the valve shaft 7*c* integrally comprising the spool valve body 7*a* and the piston part 7*b*.

The supporting member 24 is supported by the heat sensitive operation mechanism comprising the fusible alloy 30. The heat sensitive operation mechanism comprises a supporting plate 25, a pressing plate 26, a lock ball 27, heat gathering plates 28, 29. the fusible alloy 30, a spacer 31 and a fastening screw 32. That is, the two heat gathering plates 28, 29 having the fusible alloy 30 fixed thereon are fixed with the supporting plate 25 via the spacer 31 and the pressing plate 26 by the fastening screw 32, with the lock ball 27 fitted in the outer periphery part of the supporting plate 25 and the pressing plate 26, and fitted with a protruding part 1*g* inside the head water discharging part 1*c* and a fitting concave part 1*f* provided below.

If the fusible alloy 30 is melted by hot air in a fire in the second heat sensitive operation part 22, the lock ball 27 enters the gap with respect to the supporting plate 25 by the release of the pressing plate 26 supporting the same via the spacer 31. Then, the part below the supporting plate 25 is separated from the head water discharging part 1*c* as shown in the lower part of the left side crosssection so as to release the maintenance of the valve shaft 7*c*. When the second heat sensitive operation part 22 starts the operation, the deflector 23 (water discharging part) accommodated inside the head water discharging part 1*c* descends so as to be exposed below the sprinkler head 1.

When the maintenance of the valve shaft 7*c* is released by the separation of the fusible alloy 30 of the second heat sensitive operation part 22 by being melted by the heat in the fire, the spool valve body 7*a* of the first heat sensitive operation part 6 is already in a state to be opened at a shape memory temperature lower than that. Therefore, when the maintenance of the valve shaft 7*c* is released, the spool valve body 7*a* comes out from the spool hole 3*a* so as to open the channel. Then, the pressed fire extinguishing water from the inflow opening 3 is discharged from the water discharging opening 5 through the communicating hole 20 of the actuator storing part 1*d*, and further, the internal channel 3*c* so as to be reflected by the deflector 23 and scattered.

With the restoring temperature of the shape-memory alloy 10 for making the state where the spool valve body 7*a* can be opened by the actuator 8 by the operation of the pilot valve 12 provided in the first heat sensitive operation part 6 defined as T1, and the water discharge starting temperature determined by the melting temperature of the fusible alloy 30 in the second heat sensitive operation part 22 defined as T2, the memory restoring temperature T1 of the shape-memory alloy 10 is set lower than the water discharge starting temperature T2.

Therefore, by receiving hot air by a fire, the actuator 8 can be in a state capable of opening the spool valve body 7*a* by the operation of the pilot valve 12 when the temperature rises to the memory restoring temperature T1 of the shape-memory alloy 10. By melting the fusible alloy 30 when the temperature reaches the water discharge starting temperature T2 by the hot air by the fire, the maintenance of the spool valve body 7*a* is released via the valve shaft 7*c* by the second heat sensitive operation part 22 so as to start the water discharge.

The water discharge starting temperature T2 of the fusible alloy 30 for starting the water discharge is accurately determined by the fusible alloy 30 material. Since the memory restoring temperature T1 of the shape-memory alloy 10 is in the stage preceding the start of the water discharge, even if the restoring force of the shape-memory alloy 10 has a range with respect to the temperature rise, the water discharge can be conducted securely at a predetermined water discharge starting temperature T2 determined by the fusible alloy 30 material without suffering the effect of the restoring force range of the shape-memory alloy 10.

Figure 3:
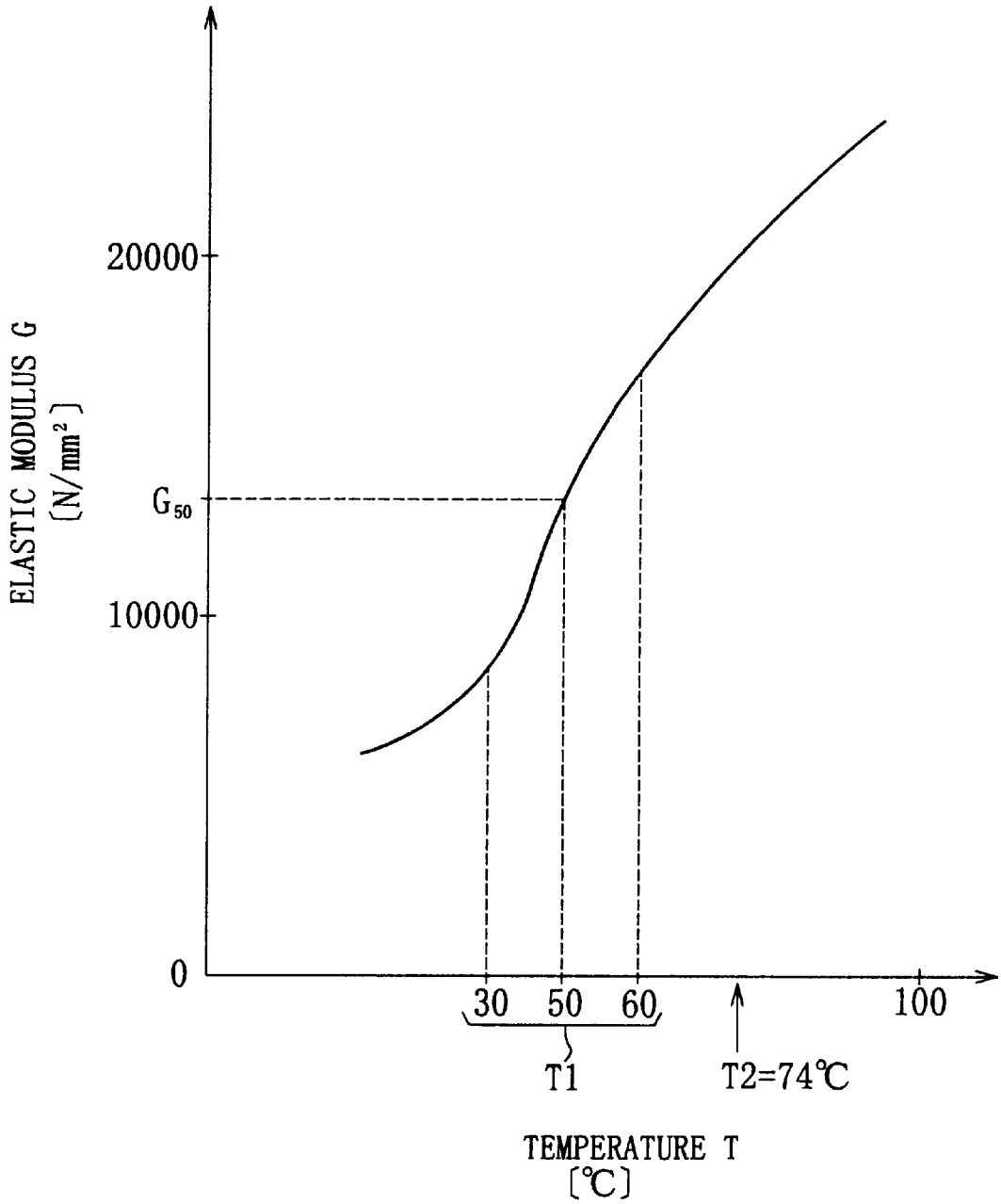
FIG. 3 is a graph showing the characteristic of the elastic coefficient actually measured with respect to the temperature of the shape-memory alloy of FIG. 1.

FIG. 3 shows the characteristic of the elastic coefficient G with respect to the temperature T of the shape-memory alloy 10 having a coil spring shape provided in the sprinkler head 1 of FIG. 1 actually measured. For example, with the water discharge starting temperature determined by the fusible alloy 30 in the second heat sensitive operation part 22 T2=74-C., the operation temperature range of the pilot valve 12 by the restoring force of the shape-memory alloy can be set in a range of T1=30 to 60-C., for example, at 50-C.

More specifically, the restoring force F2 of the restoring spring 14 is determined such that the channel of the pilot discharge path 18 of the pilot valve body 12*a* is closed in balance with the restoring force F1 of the shape-memory alloy 10 based on the elastic coefficient G50 at 50-C. in FIG. 3. That is, the restoring force F2 is set equally or slightly higher than the restoring force F1 of the shape-memory alloy 10.

Accordingly, when the temperature of the shape-memory alloy 10 reaches T1=50-C., the restoring force F1 of the shape-memory alloy 10 exceeds the restoring force F2 of the restoring spring 14 so as to push up the pilot valve body 12*a* and close the pilot inflow path 15 simultaneously to be in the state for discharging the pilot pressure from the diaphragm room 9*a* of the actuator 8.

When at least one of a plurality of the shape-memory alloys 10 provided in the outer periphery of the head water discharging part 1*c* reaches the shape restoring temperature T1, the spacer 11 is ascended so as to operate the pilot valve 12 to be in the water discharge available state. Accordingly, delay of the temperature detection by the air flow effect can be prevented. That is, if only one shape memory alloy 10 is provided, a long time is needed for the temperature rise of the shape-memory alloy 10 by the hot air when it is applied far from the shape-memory alloy 10. On the other hand, when a plurality of the shape-memory alloys 10 are provided as in the present invention, the fire temperature can be detected securely regardless of the hot air direction so as to start the water discharge.

Further, the protruding part 1*e* elongating at the outer periphery of the end part of the head water discharging part 1*c* also serves for repelling water for preventing the water discharge stoppage before extinguishing a fire by the discharged fire extinguishing water poured onto the shape-memory alloy 10 so as to directly cool down the same.

The plurality of the shape-memory alloys 10 provided around the second heat sensitive operation part 22 are provided above the exposing position of the deflector 23 as the water scattering part for scattering around the fire extinguishing water during the operation of the second heat sensitive operation part 22. Therefore, the water discharge stoppage before extinguishing the fire by blocking the hot air toward the shape-memory alloys 10 by the fire extinguishing water without cooling the shape-memory alloy by the discharged fire extinguishing water so that the malfunction can be prevented by accurately detecting the periphery heat.

More specifically, the shape-memory alloy 10 can be provided as long as it is positioned above the upper surface of the fire extinguishing water to be scattered by the deflector 23.

Figure 4:
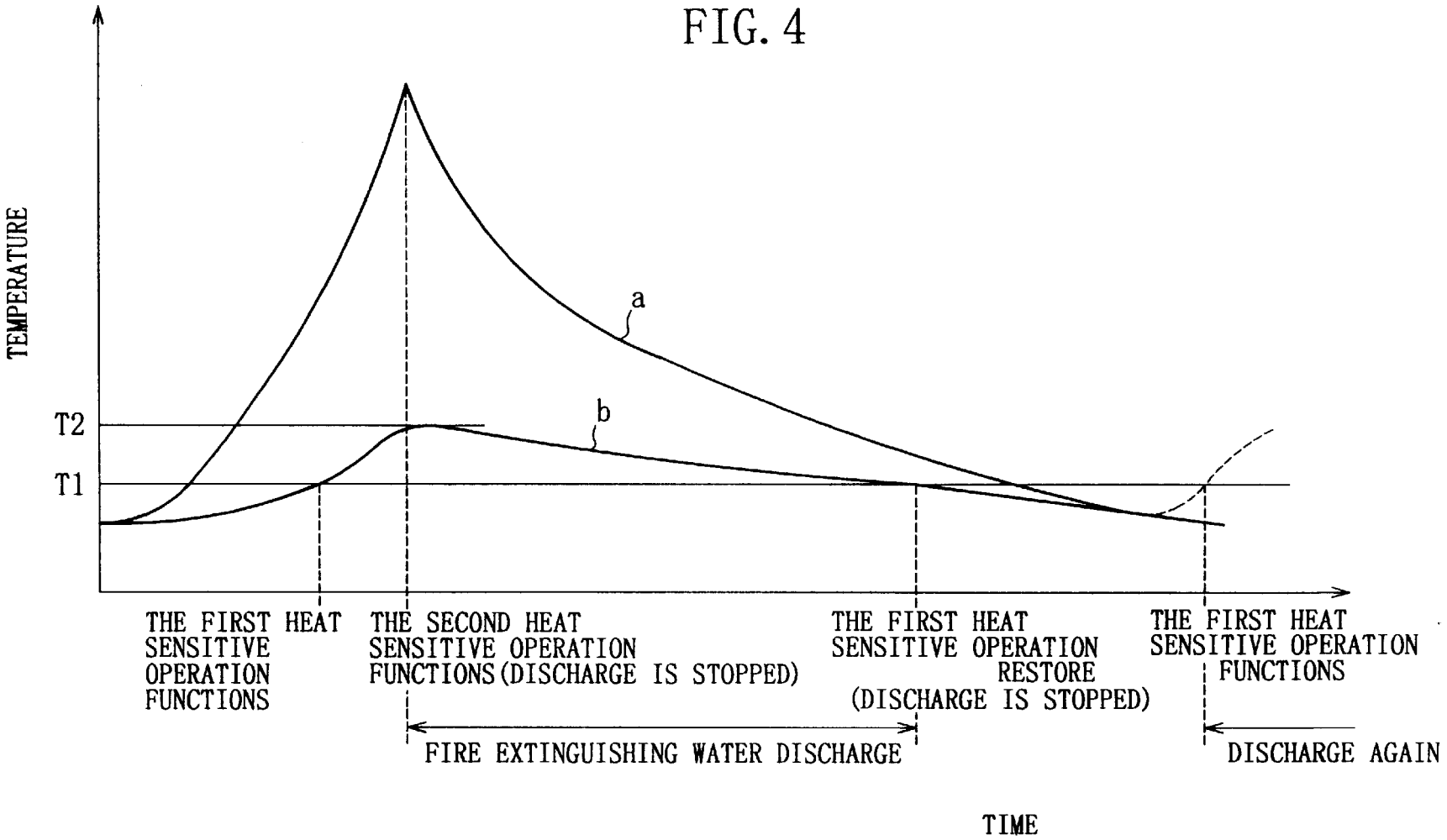
FIG. 4 is a graph for explaining the operation of the first embodiment of the present invention.

The operation of the embodiment shown in FIG. 1 will be explained with reference to FIG. 4. FIG. 4 is a graph showing the operation of each part of the sprinkler head in with respect to the surrounding temperature. Herein the curve a is a temperature curve immediately above the fire source, and the curve b is a temperature curve surrounding the sprinkler head 1 provided away from the position immediately above the fire source.

In a low temperature to be in a constant monitor state, the restoring force F2 of the restoring spring 14 is larger than the restoring force F1 of the shape-memory alloy 10 provided in the first heat sensitive operation part 6 in a constant temperature so that it is contracted in the initial shape via the space 11 as illustrated. Therefore, the pilot valve 12 opens the pilot inflow path 15 to the pilot valve room 12*b* by the pilot valve body 12*a* so as to be maintained at a valve position closing the pilot discharge path 18.

Accordingly, the pressure from the pressed fire extinguishing water filled in the fire extinguishing piping supplied from the inflow opening 3 is supplied to the diaphragm room 9*a* of the actuator 8 as the pilot pressure. The pilot pressure pushes up the diaphragm 8*a* and the piston part 7 as illustrated so that the spool valve body 7*a* at the tip of the valve shaft 3*c* is positioned at the spool hole 3*a* for closing the channel from the inflow opening 3 with respect to the internal channel 3*b*.

By receiving hot air by a fire in this state, the restoring force F1 of the shape-memory alloy 10 exceeds the restoring force F2 of the restoring spring 14 when the temperature reaches a predetermined memory restoring temperature T1 at which the shape was memorized. Then, the pilot valve body 12*a* is pushed up by the valve shaft 12*c* via the spacer 11 for closing the pilot inflow path 15 and at the same time opening the pilot discharge path 18 to the pilot valve room 12*b*.

Therefore, the pilot pressure supplied to the diaphragm room 9*a* of the actuator 8 is discharged from the pilot discharge path 18 from the pilot supply path 16 and the pilot valve room 12*b* so that the force for pushing the spool main body 7*a* to the position for closing the spool hole 3*a* is released. However, since the second heat sensitive operation part 22 is not operated so that the valve shaft 7*c* is maintained at a position where the spool valve body 7*a* is positioned at the spool hole 3*a* in a closed state.

Accordingly, when the temperature is raised by hot air by a fire with the first heat sensitive operation part 6 functioning to the water discharge starting temperature T2 where the fusible alloy 30 of the second heat sensitive operation part 22 is melted, the fusible alloy 30 is melted. When the fusible alloy 30 is melted, the supporting plate 26 descends with the spacer 31 and the heat gathering plates 28, 29 so that the lock by the lock ball 27 can be released. Then, the members of the heat sensitive operation mechanism below the supporting plate 25 are disassembled to fall off as shown in the left side cross-section in FIG. 1.

Accordingly, the maintenance of the valve shaft 7*c* in the closed state by the supporting member 24 can be released so that it falls down to the opening part 1*h* of the head water discharging part 1*c* with the deflector 23 so as to be maintained by the protruding part 1*g*. By the release of the maintenance of the valve shaft 7*c*, since the actuator 8 can drive the spool valve body 7*a* into the opened state already, the spool valve body 7*a* descends by the pressure of the fire extinguishing water from the inflow opening 3 so as to open the spool hole 3*a*.

Accordingly, the fire extinguishing water from the inflow opening 3 is discharged from the water discharging opening 5 toward the deflector 23 through the spool hole 3*a*, the internal channel 3*b*, the communicating hole 20 and the internal channel 3*c* so as to be scattered around by the contact with the deflector 23. Since the fire loses the force by the fire extinguishing water discharge, the hot air temperature gradually drops as shown by the curve b of FIG. 4.

When the fire is extinguished by the fire extinguishing water discharge, the temperature is lowered for not receiving the hot air. When the temperature of the shape-memory alloy 10 becomes lower than the memory restoring temperature T1 by the temperature decline, the restoring force F1 of the shape-memory alloy 10 becomes smaller than the restoring force F2 of the restoring spring 14 so that the shape-memory alloy 10 is deformed into the initial shape by being forced by the restoring spring 14 as illustrated.

At the time, the pilot valve body 12*a* of the pilot valve 12 closes the pilot discharge path 18 and at the same time opens the pilot inflow path 15 so that the pressure of the pressed fire extinguishing water with respect to the inflow opening 3 is supplied to the diaphragm room 9*a* of the actuator as the pilot pressure. Accordingly, the spool valve body 7*a* is pushed up by the diaphragm 8*a* and the piston part 7*b* so as to be fitted into the spool hole 3*a* for closing the channel. Then, the fire extinguishing water discharge can be stopped automatically.

If the fire regains the momentum by any chance as shown by the broken line in FIG. 4 after automatically stopping the fire extinguishing water discharge so that the temperature of the shape-memory alloy 10 is raised by the hot air to the memory restoring temperature T1, the pilot valve 12 functions again for discharging the pilot pressure in the diaphragm room 9*a*. Since the second heat sensitive operation part 22 is already functioning, the spool valve body 7*a* is taken out downward from the spool hole 3*a* for opening the channel by the fire extinguishing water pressure accompanying the pilot pressure discharge from the diaphragm room 9*a* so as to resume the fire extinguishing water discharge.

When the fire is extinguished after the resumption of the water discharge so that the temperature of the shape-memory alloy 10 becomes lower than the memory restoring temperature T1, the shape-memory alloy 10 is deformed into the initial shape by the restoring force 2 of the restoring spring 14. Then, the pilot valve 12 is switched into the state for supplying the pilot pressure to the diaphragm room 9*a* so that the spool valve body 7*a* returns to the spool hole 3*a* thereby for closing the channel again for stopping the water discharge.

Figure 5:
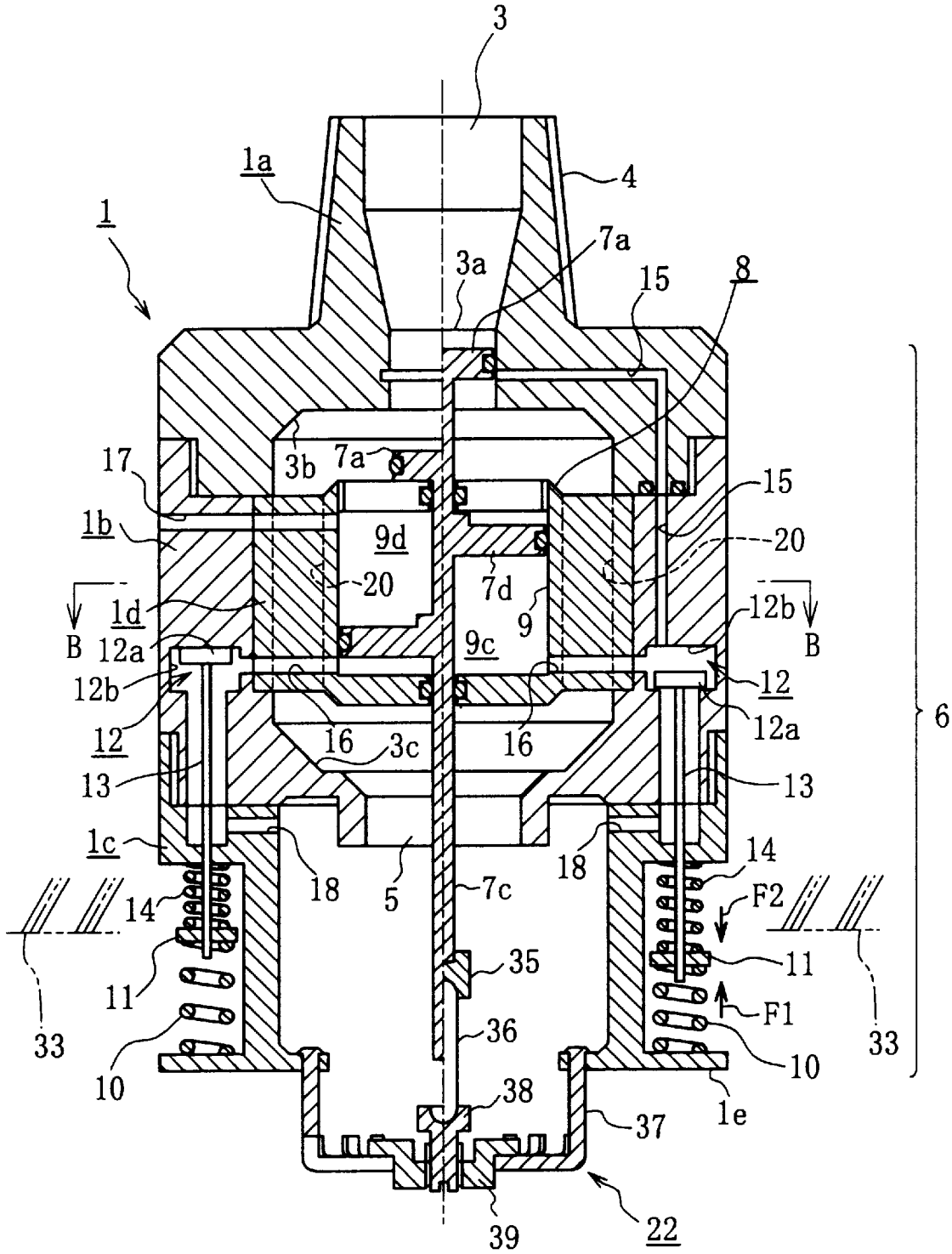
FIG. 5 is a cross-sectional view showing half each of the monitor state and the water discharge state of a second embodiment of the present invention.

FIG. 5 shows a second embodiment of an automatically switchable sprinkler head of the present invention. The right side with respect to the center line in the axial direction shows the cross-section of a state when the water discharge is ceased at a low temperature, and the left side shows the cross-section of a state in the water discharging operation subject to hot air in a fire. In the second embodiment, a glass valve is used for the second heat sensitive operation part 22.

In FIG. 5, an automatically switchable sprinkler head 1 comprises a head connecting part 1*a*, a head main body part 1*b*, and a head water discharging part 1*c* from the above, screwed to each other. An actuator storing part 1*d* is assembled inside the central head main body part 1*b*, with the spool hole 3*a* formed at the end part, and the spool valve body 7*a* formed at one end of the valve shaft 7*c* slidably assembled.

The actuator 8 is assembled in the actuator storing part 1*d* accommodated inside the head main body part 1*b*. In this embodiment, an actuator piston 7*d* is formed in the valve shaft 7*c* in place of the diaphragm piston as the actuator 8, slidably assembled in the cylinder 9.

The cylinder 9 is partitioned into the lower cylinder room 9*c* and the upper cylinder room 9*d* by the actuator piston 7*d*. The actuator 8 is operated by a plurality of the pilot valves 12. The pilot valve body 12*a* is assembled in the pilot valve room 12*b*, with the pilot valve room 12*b* communicating with the pilot inflow path 15 from the above, and the pilot supply path 16 communicating with the cylinder room 9*c* in the pilot valve 12.

Furthermore, the valve shaft 13 integrally elongating from the lower part of the pilot valve body 12*a* is provided, with the pilot discharge path 18 connected with the inside of the head water discharging part 1*c* for accommodating the valve shaft 13. The tip of the valve shaft 13 is fixed to the spacer 11, with the shape-memory alloy 10 assembled in the lower side of the spacer 11 and the restoring spring 14 assembled in the upper side of the spacer 11.

The first heat sensitive operation part 6 of this embodiment is provided with a configuration including the spool valve body 7*a*, the actuator 8, the shape-memory alloy 10, the restoring spring 14 and the pilot valve 12.

Figure 6:
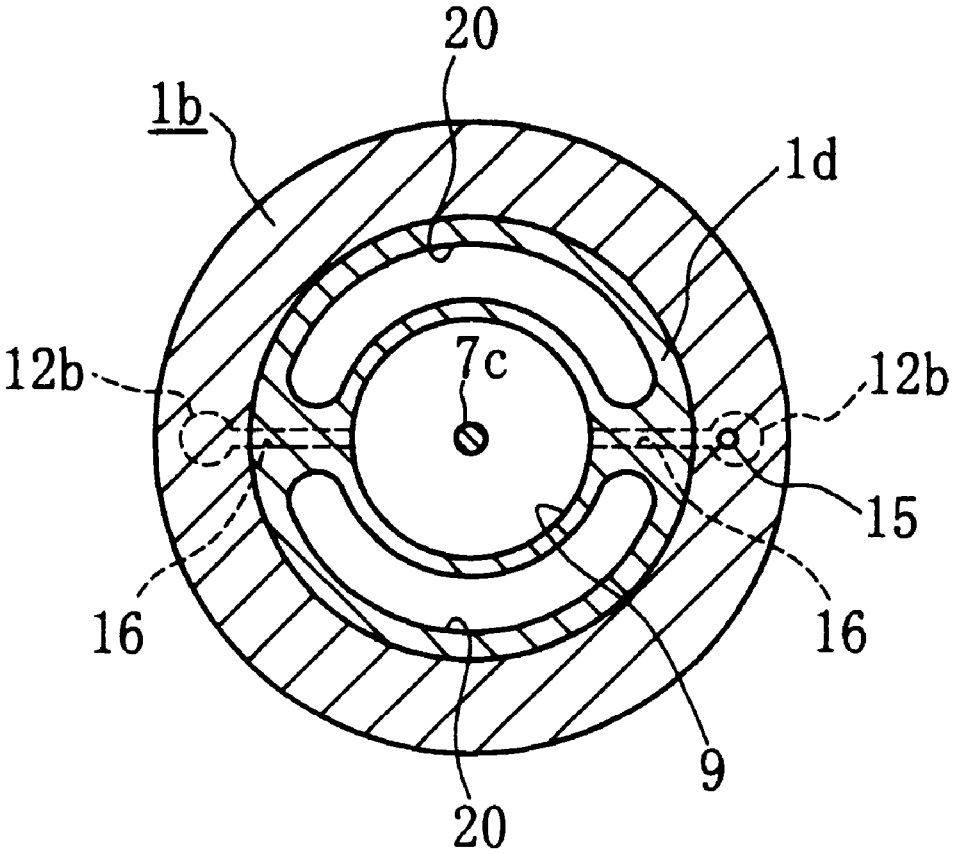
FIG. 6 is a cross-sectional view taken on the line B—B of FIG. 5.

FIG. 6 is a cross-section of the head main body part 1*b* of FIG. 5 taken on the line B—B. As apparent from the cross-section, the actuator storing part 1*d* is assembled inside the head main body 1*b*, with the actuator storing part 1*d* provided with communicating holes 20 separated in two positions. The cylinder 9 is formed at the center part of the actuator storing part 1*d*, with the center penetrated by the valve shaft 7*c* comprising the spool valve body 7*a* and the actuator piston 7*d*.

The pilot supply path 16 communicates with the cylinder room of the cylinder 9 from the pilot valve rooms 12*b* provided in the number the same as that of the shape-memory alloys. The pilot inflow path 15 is formed upward from one of the pilot valve rooms 12*b*.

As shown in FIG. 5, the atmosphere communicating path 17 is connected to the cylinder room 9*d* above the actuator piston of the cylinder 9.

The second heat sensitive operation part 22 is provided for the head water discharging part 1*c*. In the second heat sensitive operation part 22 of this embodiment, the glass valve 36 is used in place of the fusible alloy 30 shown in FIG. 1 as a part of itself. The glass valve 36 is provided between the lower end of the valve shaft 7*c* and the supporting member 39 fixed by screwing to the supporting member 33 at the center of the deflector 37 mounted to the lower opening part of the head water discharging part 1*c* so as to maintain the spool valve body 7*a* at the tip of the valve shaft 7*c* located at the spool hole 3*a* in a closed state.

The position of the spool valve body 7*a* by the glass valve 36 can be slightly adjusted by screwing of the supporting member 38 with respect to the supporting member 39. As it is known, the glass valve 36 has a configuration where an alcohol solution is sealed in a capsule-like glass container so that the solution expands to break the glass capsule when it received hot air. As the temperature for breaking the glass valve 36, a predetermined operating temperature, that is, a predetermined water discharge starting temperature T2 in the sprinkler head 1 of the present invention is set. The memory restoring temperature T1 of the shape-memory alloy 10 provided in the first heat sensitive operation part 6 is set lower than the water discharge starting temperature T2 determined by the glass valve 36.

In the embodiment of FIG. 5, a plurality of the shape-memory alloys 10 are provided around the head water discharging part 1*c*, and a spacer 11, a restoring spring 14, and a pilot valve 12 are provided for each shape-memory alloy 10.

Since the shape-memory alloys 10, the restoring springs 14, and the pilot valves 12 are provided in plural positions around the sprinkler head 1, the shape-memory alloy 10 at a position receiving the hot air most starts the operation regardless of the hot air direction by a fire. The shape-memory alloy 10, which started the operation, discharges the pilot pressure from the cylinder room 9*c* by the pilot valve 12. When the temperature is raised by the hot air to the water discharge starting temperature T2 determined by the glass valve 36, the maintenance of the spool valve body 7*a* in the closed state is released by the breakage of the glass valve 36 so that the fire extinguishing water is discharged.

On the other hand, the water discharge is stopped by the temperature drop after extinguishing the fire by the water discharge when the temperature of all of the shape-memory alloys 10 provided in the plural positions around the sprinkler head 1 becomes lower than the memory restoring temperature T1. That is, when all of the shape-memory alloys 10 deform into the illustrated initial shape by the restoring spring 14 so as to restore the pilot valve 12, the pilot pressure supply from the actuator 8 to the cylinder room 9*c* becomes effective. At the time, the spool valve body 7*a* returns to the spool hole 3*a* by being pushed up by the actuator piston 7*d* so as to close the channel for stopping the water discharge.

Figure 7:
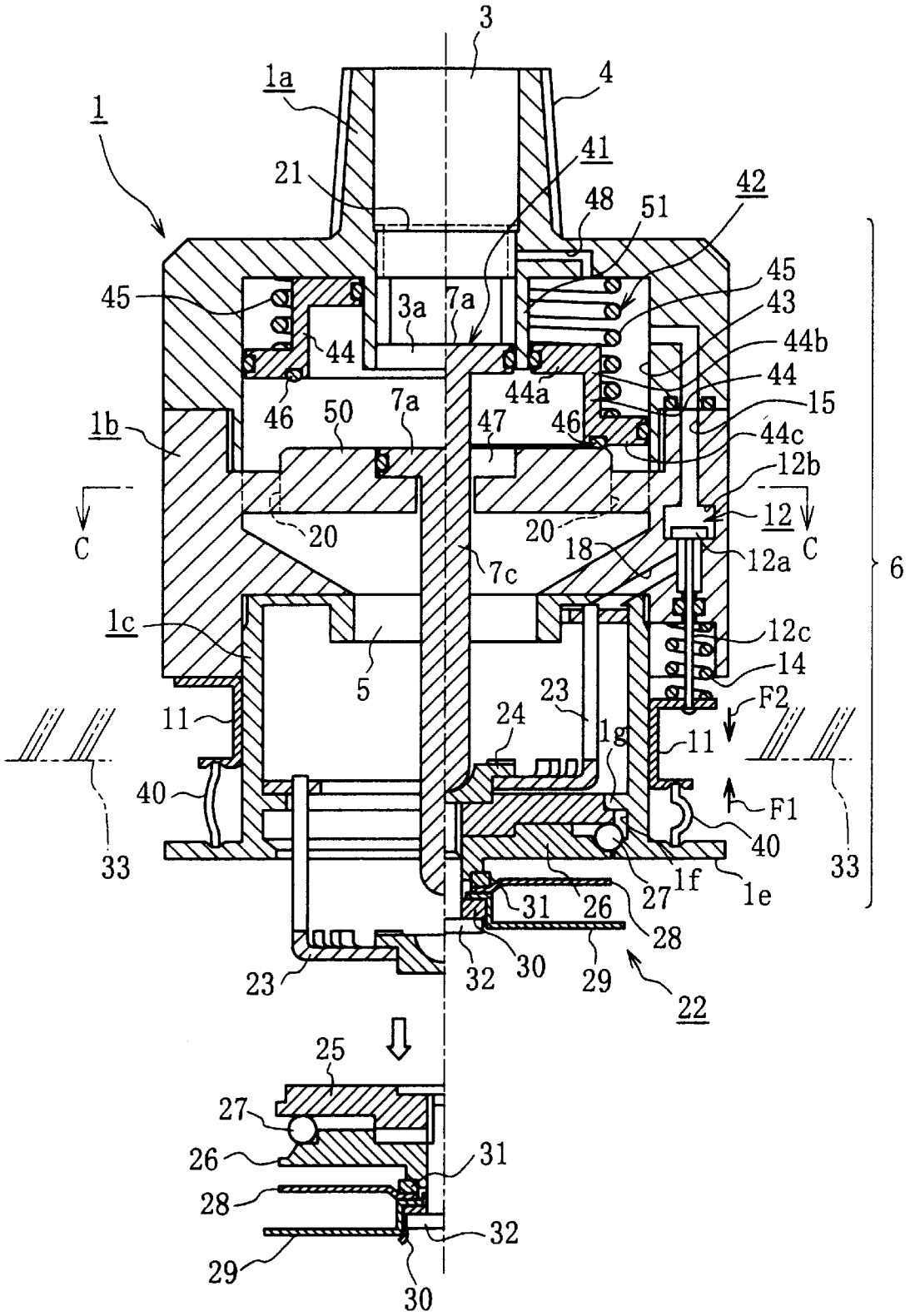
FIG. 7 is a cross-sectional view showing half each of the monitor state and the water discharge state of a third embodiment of the present invention.

FIG. 7 shows a third embodiment of an automatically switchable sprinkler head of the present invention. The right side with respect to the center line in the axial direction shows the cross-section of a state when the water discharge is ceased at a low temperature, and the left side shows the cross-section of a state in the water discharging operation subject to hot air in a fire.

In the third embodiment shown in FIG. 7, an automatically switchable sprinkler head 1 has a split configuration, comprising a head connecting part 1*a*, a head main body part 1*b*, and a head water discharging part 1*c*, screwed to each other. An inflow opening 3 is provided to the heat connecting part 1*a*, the strainer 21 is assembled in the inflow opening 3, and the spool hole 3*a* is formed for accommodating the spool valve body 7*a*.

The spool valve body 7*a* comprises the first valve mechanism 41 for maintaining the tip of the valve shaft 7 in a closed state with the second heat sensitive operation part 22 mounted below. The second valve mechanism 42 is provided around the first valve mechanism 41. The second valve mechanism 42 accommodates the valve piston 44 slidably in the cylinder 43 partitioned by the partition wall 50 of the head connecting part 1*a* and the head main body part 1*b* via the spring 45 provided above.

The valve piston 44 accommodates the inner periphery hole of the small diameter part 44*a* slidably in the cylindrical guide part 51 formed surrounding the spool hole 3*a* communicating with the inflow opening 3 and the large diameter part 44*c* with the level gradation in the axial direction slidably in the cylinder 43 via the cylindrical part 44*b*. Furthermore, the valve seal 46 is mounted on the end face of the large diameter part 44*c* for conducting the switching operation by the pressure on the end face of the partition wall 50 of the head main body part 1*b*.

Figure 8:
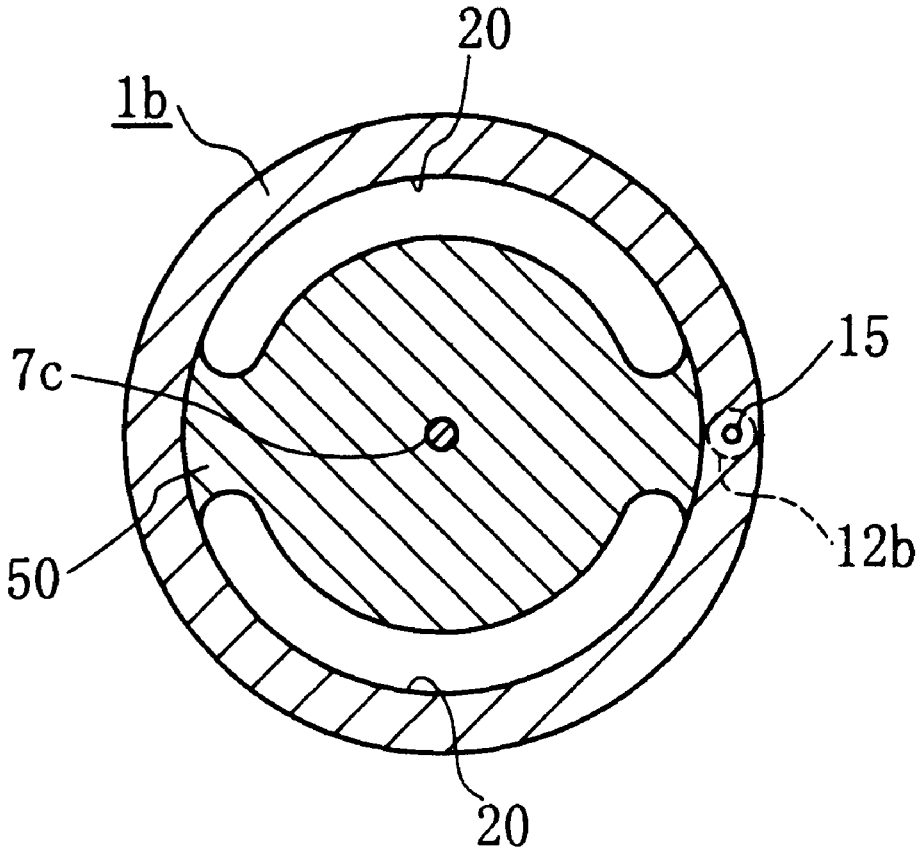
FIG. 8 is a cross-sectional view taken on the line B—B of FIG. 7.
Figure 9:
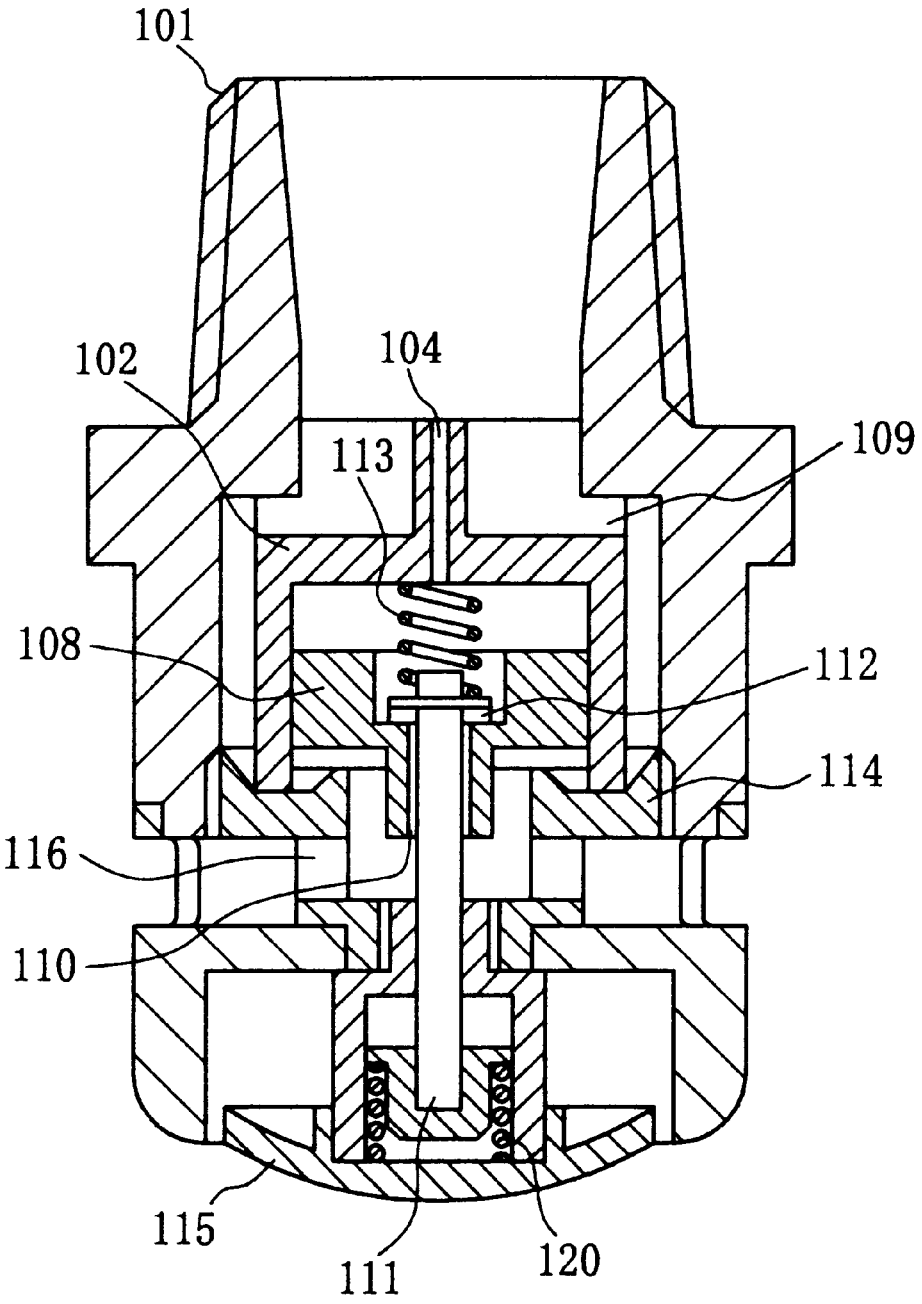
FIG. 9 is a cross-sectional view of a conventional sprinkler head.
Figure 10:
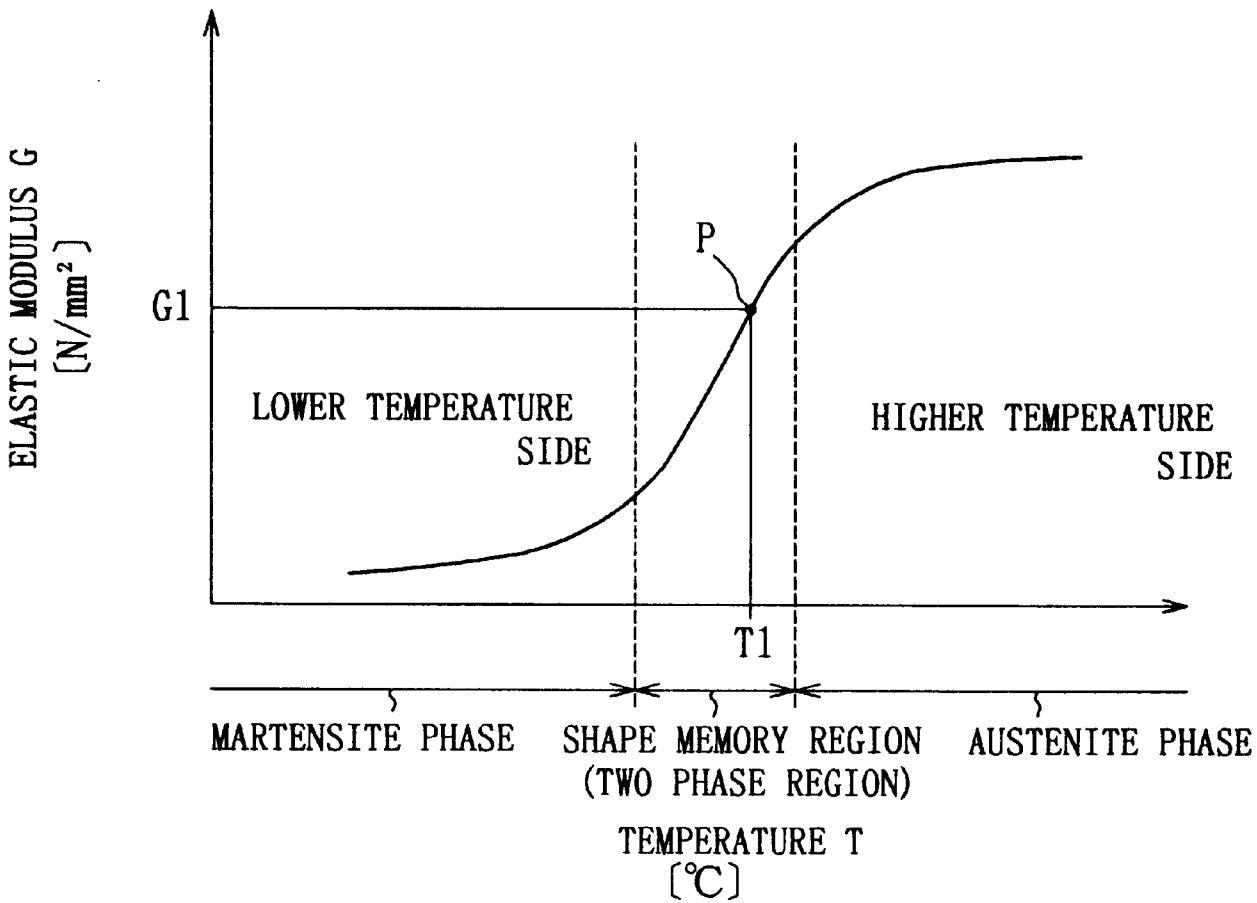
FIG. 10 is a graph showing the characteristic of the elastic coefficient with respect to the temperature of the shape-memory alloy.

FIG. 8 shows the cross-section taken on the line C—C in FIG. 7. The communicating holes 20 are formed in two positions partitioned by the partition wall 50 of the head main body part 1*b*, with the valve shaft 7*c* comprising the spool valve body 7*a* penetrating the center. The pilot inflow path 15 is formed for the pilot valve 12 in the periphery wall part.

As shown in FIG. 7, the pilot inflow path 48 is connected with the cylinder room accommodating the spring 45 of the valve piston 44 from the inflow opening 3. The pilot valve 12 is provided for the head main body part 1*b*. The pilot inflow path 15 communicates with the pilot valve room 12*b* of the pilot valve 12 from the cylinder room of the second valve mechanism 42. Furthermore, the opposite side of the pilot valve body 12*a* is connected with the inside of the head water discharging part 1*c* by the pilot discharge path 18.

The valve shaft 12*c* of the pilot valve 12 is taken out downward. The cylindrical spacer 11 is fixed to the tip of the valve shaft 12*c*, and the shape-memory alloy 40 is mounted between the lower part of the spacer 11 and the protruding part 1*e* elongating to the outer periphery end part of the head water discharging part 1*c*. In this embodiment, the shape-memory alloy 40 has a plate spring shape bent in the arc-like shape in the center. It memorizes the shape with the arc part stretched as shown in the left side cross-section when the temperature exceeds the memory restoring temperature by the hot air in the fire.

The first heat sensitive operation part 6 of this embodiment is provided with a configuration including the second valve mechanism 42, the shape-memory alloy 40, the restoring spring 14 and the pilot valve 12. The second valve mechanism 42 also serves as the actuator to be driven by the introduction or discharge of the pilot pressure.

As the second heat sensitive operation part 22 provided at the head water discharging part 1*c*, the fusible alloy 30 the same as the one used in the first embodiment shown in FIG. 1 is used as a part of itself. The memory restoring temperature T1 of the shape-memory alloy 40 is set lower than the water discharge starting temperature T2 in the second heat sensitive operation part 22 determined by the fusible alloy 30.

The operation of the third embodiment of FIG. 7 will be explained. In a constant monitor state at a low temperature, the shape-memory alloy 40 maintains the initial shape as the plate spring bent at the center in the arc shape by receiving the pressure from the restoring spring 14 as shown in the right side cross-section shown in FIG. 7. At the time, the pilot valve 12 shuts the communication with the pilot discharge path 18 by the pilot main body 12*a*.

Accordingly, the pressure of the pressed fire extinguishing water is applied to the cylinder room of the second valve mechanism 42 from the pilot inflow path 48 so as to push down the valve piston 44, combined with the force of the spring 45. The valve seal 46 mounted on the end face of the large diameter part 44*c* is pressed against the partition wall 50 of the head main body part 1*b* so as to be in the state with the valve closed.

If the shape-memory alloy 40 in the constant monitor state at a low temperature is heated to the predetermined memory restoring temperature T1 by the hot air in the fire, the shape-memory alloy 40 stretches in the axial direction so as to push up the pilot valve body 12*a* by the valve shaft 12*c* via the spacer 11, resisting to the restoring spring 14. Then, the pilot inflow path 15 is opened to the pilot discharge path 18 so as to discharge the pressure applied on the cylinder room of the second valve mechanism 42. Accordingly, the valve piston 44 is pressed and supported in the closed state only by the spring 45.

If the temperature is raised by the hot air to reach the water discharge starting temperature T2, the fusible alloy 30 provided in the second heat sensitive operation part 22 is melted so that the members provided below the supporting plate 22 are disassembled to fall off as shown at the lower side of the left side cross-section. Accordingly, the maintenance of the spool valve body 7*a* in the closed state by the first valve mechanism 41 via the valve shaft 7*c* is released so that the spool valve body 7*c* descends by the pressure of the fire extinguishing water from the inflow opening 3 so as to be accommodated in the spool storing part 47.

Therefore, the pressed fire extinguishing water flows inside the valve piston through the inflow opening 3 and the spool hole 3*a* so as to push up the valve piston 44, resisting to the spring 44 as shown in the left side cross-section so that the second valve mechanism 42 is released from the closed state by the valve seal 46. The introduced fire extinguishing water is discharged from the water discharging opening 5 provided in the lower part through the communicating hole 20 connected with the periphery part of the partition wall 50 as shown by the broken line so as to be contacted with the deflector 23 dropped downward by the heat sensitive operation of the second heat sensitive operation part 22 so as to be scattered.

When the fire is extinguished by the fire extinguishing water discharge from the sprinkler head 1 so as to lose the hot air and lower the temperature, the restoring force F1 of the shape-memory alloy 40 becomes lower than the restoring force F2 of the restoring spring 14 with the temperature lower than the predetermined memory restoring temperature T1. The shape-memory alloy 40 is pressed by the restoring spring 14 so as to be deformed into the initial shape shown in the left side cross-section. Then the pilot valve body 12*a* of the pilot valve 12 blocks the communication with the pilot discharge path 18.

Accordingly, the pressed fire extinguishing water is introduced to the cylinder room of the valve piston 44 form the pilot inflow path 48 so that the valve piston 44 descends as shown in the right side cross-section for contacting the valve seal 46 with the partition wall 50 and closing the inflow path leading to the communicating hole 20 so as to automatically stop the water discharge.

If the temperature of the shape-memory alloy 40 becomes higher than the memory restoring temperature T1 by the hot air by the recurrence of the fire after stopping the water discharge, the pilot valve body 12*a* of the pilot valve 12 is driven by the restoring force so as to make a state communicating with the pilot discharge path 18. Then, since the pressure applied on the cylinder room accommodating the spring 45 of the second valve mechanism 42 is discharged, the valve piston 44 ascends by the fire extinguishing water pressure applied on the inside of the valve piston 44 as shown in the left side cross-section so that the valve seal 46 is detached from the end face of the partition wall 50 for opening the channel again for the water discharge. When the temperature of the shape-memory alloy 40 becomes lower than the memory restoring temperature T1 by the water discharge, the water discharge is automatically stopped again.

The present invention is not limited to the above-mentioned embodiments but other optional configurations can be employed as long as the memory restoring temperature T1 of the shape-memory alloy for generating the restoring force for the heat sensitive operation of the first heat sensitive operation part is set lower than the water discharge starting temperature T2 of the fusible alloy or the glass valve for starting the water discharge at the second heat sensitive operation part, and thus the present invention is not limited by the above-mentioned embodiments.

Furthermore, the shape-memory alloy 10 and the restoring spring 14 do not always need to be provided, pressing with each other, but can be provided, facing with each other such that the restoring spring 14 can function for returning the shape-memory alloy into the initial state when it is lower than the memory restoring temperature T1.

What is claimed is:

1. A closed type sprinkler head for discharging fire extinguishing water in a fire, comprising a valve mechanism for switching the channel of the fire extinguishing water, connected to a fire extinguishing piping filled with the fire extinguishing water supplied with pressure, wherein a first heat sensitive operation part where a shape-memory alloy and a restoring force member are arranged facing to each other so that the shape-memory alloy is deformed to an initial shape by the restoring force member so as to maintain a valve mechanism at a water discharge stopping position when the temperature of the shape-memory alloy is lower than a predetermined memory restoring temperature, and the valve mechanism can be driven to a water discharging position by the restoring force of the shape-memory alloy to a memorized shape when the temperature of the shape-memory alloy reaches the memory restoring temperature, and a second heat sensitive operation part where a predetermined water discharge starting temperature higher than the memory restoring temperature is set so that the valve mechanism is maintained in a closed state regardless of the operation state of the first heat sensitive operation part when the temperature is lower than the water discharge starting temperature, and the closure of the valve mechanism is released so as to discharge fire extinguishing water by thermally disassembling itself at least partially when the temperature reaches the water discharge starting temperature are provided.

2. The sprinkler head according to claim 1, wherein the valve mechanism is in a state capable of being driven to the water discharging position, with the shape-memory alloy temperature lower than the memory restoring temperature, the valve mechanism is closed so as to cease the water discharge by the deforming the shape-memory alloy into the initial state by the restoring force member in the first heat sensitive operation part.

3. The sprinkler head according to claim 2, wherein if the shape-memory alloy temperature regains the memory restoring temperature after stopping the water discharge by deforming the shape-memory alloy in the initial shape by the temperature drop by the water discharge in the first heat sensitive operation part, the water is discharged again by driving the valve mechanism to the water discharging position by the restoring force of the shape-memory alloy to the memorized shape.

4. The sprinkler head according to any of claims 1 to 3, wherein the a plurality of shape-memory alloys are provided in the first heat sensitive part, surrounding the second heat sensitive operation part so that the valve mechanism can be driven to the water discharging position when at least one of the plurality of the shape-memory alloys restores the memorized shape, and the valve mechanism is driven into the closed state so as to stop the water discharge when all of the plurality of the shape-memory alloys restore the initial shape.

5. The sprinkler head according to claim 4, comprising a water sprinkling part to be exposed below the sprinkler head when the second heat sensitive operation part is driven, with the plurality of the shape-memory alloys provided above the exposed water sprinkling part exposed below.

6. The sprinkler according to claim 1, wherein the shape-memory alloy has an initial shape of a coil spring contracted in the axial direction and a memorized shape of a coil spring stretched in the axial direction.

7. The sprinkler head according to claim 1, wherein the shape-memory alloy has an initial shape of a plate spring shape with the center bent in an arc-like shape, and a memorized shape of a plate spring shape stretched in the axial direction.

8. The sprinkler head according to claim 1, wherein the valve mechanism comprises a main valve provided switchably in the channel from the inflow opening to the water discharging opening, an actuator for driving the main valve into the closed position by the pilot pressure supply and driving the main valve into the opened position by the pilot pressure discharge, and a pilot valve for supplying the pilot pressure to the actuator at the valve position determined by the initial shape of the shape-memory alloy so as to close the main valve and discharging the pilot pressure from the actuator at the valve position determined by the shape-memory alloy deformation to the memorized shape so as to open the main valve for the water discharge.

9. The sprinkler head according to claim 8, wherein the actuator comprises a shaft member having a diaphragm piston or a piston slidably by the introduction or discharge of the pilot pressure integrally, with the diaphragm piston or the piston maintained at the closed state by the second heat sensitive operation part in the ordinary state.

10. The sprinkler head according to claim 1, wherein the valve structure comprises a first valve member provided switchably in the channel from the inflow opening to the water discharging opening, maintained at the closed position by the second heat sensitive operation part, to be driven to the opened position by the release at the time of attaining the water discharge starting temperature for the water discharge, a second valve member provided in the secondary channel of the first valve member for switching the channel, an actuator for driving the second valve member to the closed state by the pilot pressure introduction from the inflow opening side and driving the second valve member to the opened state by the pilot pressure discharge, and a pilot valve for introducing the pilot pressure to the actuator at the valve position determined by the initial shape of the shape-memory alloy so as to drive the second valve member in the closed state and discharging the pilot pressure at the valve position determined by the shape-memory alloy deformation into the memorized state for discharging water, and driving the second valve member into the closed state for stopping the water discharge by the re-introduction of the pilot pressure when the shape-memory alloy restores the initial shape after driving the first valve member into the opened position.

11. The sprinkler head according to claim 1, wherein the second heat sensitive operation part comprises a fusible alloy or a glass valve to be disassembled by the heat attaining the water discharge starting temperature so as to be removed from the second heat sensitive operation part.

* * * * *